US009016605B2

(12) United States Patent
Bourgeois

(10) Patent No.: US 9,016,605 B2
(45) Date of Patent: Apr. 28, 2015

(54) FACILITY FOR GRINDING INORGANIC MATERIAL, HAVING A ROLLER PRESS

(75) Inventor: Marcel Bourgeois, Saint-Egreve (FR)

(73) Assignee: VICAT (FR)

( * ) Notice: Subject to any disclaimer, the term of this patent is extended or adjusted under 35 U.S.C. 154(b) by 309 days.

(21) Appl. No.: 13/695,040

(22) PCT Filed: Apr. 21, 2011

(86) PCT No.: PCT/FR2011/050922

§ 371 (c)(1),
(2), (4) Date: Mar. 15, 2013

(87) PCT Pub. No.: WO2011/135237

PCT Pub. Date: Nov. 3, 2011

(65) Prior Publication Data

US 2013/0168476 A1 Jul. 4, 2013

(30) Foreign Application Priority Data

Apr. 29, 2010 (FR) ..... 10 53319

(51) Int. Cl.

| | |
|---|---|
| ***B02C 13/00*** | (2006.01) |
| ***B02C 23/08*** | (2006.01) |
| ***B02C 23/14*** | (2006.01) |
| ***B02C 4/02*** | (2006.01) |
| ***B02C 23/30*** | (2006.01) |

(Continued)

(52) U.S. Cl.

CPC . *B02C 23/14* (2013.01); *B02C 4/02* (2013.01); *B02C 23/30* (2013.01); *B02C 23/32* (2013.01); *B02C 4/00* (2013.01)

(58) Field of Classification Search

USPC ..... 241/19, 79, 79.1

See application file for complete search history.

(56) References Cited

U.S. PATENT DOCUMENTS 8,083,165 B2 * 12/2011 Mangelberger et al. ..... 241/79.1
8,322,642 B2 * 12/2012 Fader ..... 241/39

(Continued)

FOREIGN PATENT DOCUMENTS

DE 3506502 A1 8/1986
DE 19526040 A1 1/1997

(Continued)

OTHER PUBLICATIONS

International Search Report issued Aug. 16, 2011 re: PCT/FR2011/050922; citing: EP 0 650 763 A1, EP 1 254 873 A2, DE 35 06 502 A1 and DE 195 26 040 A1.

*Primary Examiner* — Faye Francis

(74) *Attorney, Agent, or Firm* — Cantor Colburn LLP

(57) ABSTRACT

A facility for grinding inorganic material include a roller press, a first static separator having an intake supplied with raw material, a dynamic separator having an intake connected to a first output of the first static separator, a ventilation circuit provided through the first static separator and the dynamic separator, and a second static separator having an intake that is connected to an output of the roller press. The first static separator includes two outputs, one for low-granulatory matter and one for larger granulatory matter, whereby the second output is connected to the roller press. The dynamic separator further includes a first output for particles having the desired granulometry and a second output for matter with larger granulometry connected to an intake of the roller press. The ventilation circuit participates in the separation, drying, and transport of low-granulometry particles.

12 Claims, 3 Drawing Sheets

(51) Int. Cl.
*B02C 23/32* (2006.01)
*B02C 4/00* (2006.01)

(56) References Cited

U.S. PATENT DOCUMENTS

| | | | | |
|---|---|---|---|---|
| 8,393,558 | B2 * | 3/2013 | Gitschel | 241/19 |
| 8,459,581 | B2 * | 6/2013 | Bai | 241/78 |
| 8,517,293 | B2 * | 8/2013 | Avant et al. | 241/65 |
| 2005/0167534 | A1 * | 8/2005 | Tomikawa et al. | 241/19 |
| 2007/0029417 | A1 * | 2/2007 | Whittaker | 241/19 |

FOREIGN PATENT DOCUMENTS

| | | | |
|---|---|---|---|
| EP | 0650763 | A1 | 5/1995 |
| EP | 1254873 | A2 | 11/2002 |

* cited by examiner

FACILITY FOR GRINDING INORGANIC MATERIAL, HAVING A ROLLER PRESS

TECHNICAL FIELD

This invention concerns a facility for grinding inorganic matter, intended in particular to be installed in a concrete mixing plant.

BRIEF DESCRIPTION OF RELATED ART

The manufacture of concrete includes various steps, each of which consumes a significant amount of energy. These steps include, in particular, two grinding steps, one at the beginning, the other at the end of the manufacturing process. These steps are energy-intensive. The first grinding step is the grinding of the raw material, representing 20-30% of the total electrical power consumption of the manufacture of concrete. It also carries out the mixing and drying of this matter, known as raw meal, before cooking it at a temperature of approximately 1450° C. The second grinding step is carried out on the product resulting from the cooking: the clinker. It represents 30-50% of the total electrical power consumption of the manufacture of concrete, and is an essential step in the production of concrete. In fact, this is the step that, by adding gypsum and additives, determines the composition and granulometry of the final product, and thus the technical characteristics of the cement. This invention, more specifically, concerns this second grinding step, that of the clinker, but can also concern the first grinding step in which the raw meal is obtained.

In the constant desire to reduce the operating costs and environmental impact of the manufacture of concrete, the facilities used in the grinding steps, in particular that of the clinker, have developed over the past roughly twenty years. Thus, until the 1980s, this type of facility used ball mills according to a grinding method consisting of passing the matter to be ground through a horizontal rotating tube that contains metal discs. This means of grinding the matter has very low energy efficiency. Later, grinding facilities developed progressively in the direction of pressing the matter, which provides better energy efficiency. This initially took the form of using roller mills, either vertical or horizontal. The substantial increase in energy efficiency that accompanied these technologies is cancelled out by the increased complexity of the facility, and, in the case of vertical roller mills, the need to wet the matter to be ground, which entails an additional step of drying, in which a great deal of heat energy is expended.

Simultaneously, both metallurgical improvements and improved granulometric separation methods for the matter allowed for the development of roller press grinding. This type of mill, which also presses the matter, uses gravity for the intake of the matter, reduces energy consumption, and simplifies the grinding facility.

Thus, the current grinding facilities, which comprise a roller press, generally comprise a static separator, usually cascade-type, serving to remove and dry the raw material, and to break and remove the agglomerated material (or discs) resulting from press-grinding, a roller press allowing for reduction of the granulometry of the matter, and a dynamic separator to select the particles having the desired granulometry. The connection of the cascade-type static separator to the roller press in this type of facility allows for recycling of material having excessive granulometry even following a first pass through the roller press. This type of facility, though perfectly suited to ensure adequate granulometry of the final product, still consumes a substantial amount of energy, due in particular to the recycling in the roller press of low-granulometry matter which should have gone to the final product.

BRIEF SUMMARY

The disclosure provides a facility for grinding inorganic matter having a roller press, which both has the grinding and drying characteristics of the current facilities, and requires a reduced amount of energy per dedicated tonnage of inorganic matter to be processed.

To this end, the invention concerns a facility for grinding inorganic matter having a roller press, including a first static separator having an intake for raw material, comprising two outputs, the first for low-granulometry matter and the second for matter with larger granulometry, whereby the latter is connected to a roller press, and the first output of the first static separator is connected to the intake of a dynamic separator comprising two outputs, a first output for particles having the desired granulometry and the second for matter with larger granulometry, connected to the intake of the roller press, in which a ventilation circuit is provided through the first static separator and the dynamic separator in order to participate in the separation, drying, and transport of the low-granulometry particles, which facility comprises a second static separator having an intake that is solely connected to the output of the roller press, and at least one of the outputs of which, for low-granulometry particles, is connected to the dynamic separator, which first static separator is fed only with raw material and through which the ventilation circuit passes.

The use of a second static separator dedicated to the output of the roller press allows for better distribution of the load between the two static separators, with the first static separator dedicated solely to receiving the raw material. This results not only in improved drying of the raw material and the ground matter, but also in better disintegration and separation of the particles of the discs resulting from the grinding in the roller press, and thus better performance of the facility (reduced amount of low-granulometry particles returning to the press). This improvement in the performance of the press and reduction in the load borne by each separator, which results in reduced differential pressure needed by the ventilation circuit, allows for a reduction in energy consumption per ton of inorganic matter processed.

Advantageously, the facility comprises a deballasting circuit.

When the roller press is started or adjusted, such a circuit allows for deballasting of the matter that has passed through the press, and, which, due to constrains related to the roller press grinding technology, has only been very slightly ground. This reduces the load borne by the press in the essential start-up and adjustment periods, thus allowing for increased useful life of the press and the dynamic separator.

Preferably, the deballasting circuit comprises a hopper, the intake of which can be temporarily connected to the output of the roller press, and the output of which is connected to the first static separator.

Thus, upon starting the press, the matter coarsely ground by the press can be stored in the hopper and gradually reintroduced with the raw material, thus limiting the load borne by the press at start-up.

According to an alternative embodiment, the deballasting circuit comprises a hopper, the intake of which can be temporarily connected to the second output of the second static separator, that of the high-granulometry matter.

Such an alternative allows during the deballasting phase for recovery of the low-granulometry particles arising from this partial grinding, whilst ensuring that the high-granulometry matter is not reintroduced into the dynamic separator, but stored in the deballasting hopper. Once the normal operation of the press has been attained, the coarsely ground matter is reintroduced gradually with the raw material.

Advantageously, at least one of the static separators is of the cascade type.

Such separators, by design, are robust, and can process coarse material, and have high disintegration and drying capacity. This type of separator is thus ideal both for processing the raw material and carrying out an initial sorting of the material once it has been ground.

The raw feed of the first static separator comprises several hoppers, a means of weighted dosing associated with each hopper, and a means for conveying the matter into the first static separator.

Feeding the first static separator, and thus the grinding facility, in this manner allows for the desired mixture constituting the final product, i.e. the concrete or raw meal (for a facility adapted for the first grinding step of the manufacture of cement) to be determined in the grinding stage by the operation of various hoppers containing different components and using means of dosing.

Preferably, the facility comprises means for detecting metallic matter, which means cause the rejection of such matter via a reject circuit.

The existence of means for detecting metallic matter coupled with a reject circuit for such matter allows for the elimination of the risk of damage to the grinding facility, which may arise from the presence of this type of matter, thus guaranteeing better composition of the finished product.

Advantageously, the first output of the dynamic separator is connected to a filtration device that allows for separation of the low-granulometry particles from the air of the ventilation circuit, and the filtration device is connected to a system for transporting the granular product.

The use of such a filtration device coupled with a transportation system allow for recovery of particles having the desired granulometry and the transportation of these particles to a storage area, or directly to the conditioning step for the final product.

Preferably, the intake of the roller press is equipped with a feed hopper.

This hopper ensures both continuous supply and control of the quantity of the matter fed into the press.

Advantageously, the second static separator comprises two outputs, one for the low-granulometry particles and one for the high-granulometry matter, the output for high-granulometry matter being connected to the dynamic separator.

Such a coupling allows for the dynamic separator to be supplied with the ground matter that has already passed through the second static separator, and has thus been acceptably disintegrated. This sequence ensures good separation of low-granulometry particles and high-granulometry matter, and thus allows for the press to be supplied with a reduced amount of matter with high granulometry (fewer low-granulometry particles in the matter reintroduced into the press), thus reducing the load on the press, which allows for an increased raw material load. This results in a significant increase in the performance of the facility as a whole for an equivalent quantity of energy. In fact, the performance to be applied for the separation of the pressed matter is that of the dynamic separator (85-90%) and not that of the first static separator (40-50%).

According to an alternative embodiment, the second static separator comprises two outputs, one for low-granulometry particles and one for the high-granulometry matter, the output for high-granulometry matter being connected to the intake of the first static separator.

Such a coupling of the second output of the second static separator with the intake of the first separator allows for the ground matter to pass through two separators, and thus for an optimization of the disintegration of the discs arising from the grinding, and optimal recovery of low-granulometry particles after each grinding.

According to another embodiment, the second static separator comprises two outputs, one for low-granulometry particles and one for the high-granulometry matter, the output for high-granulometry matter being directly connected to the roller press.

Advantageously, at least one intake and/or output of at least one separator is equipped with sealing.

Such a sealing allows for limitation of "false air" that may arise at the level of the separators.

BRIEF DESCRIPTION OF THE DRAWINGS

The invention will be better understood using the following description, which refers to the attached schematic, showing three exemplary embodiments of this facility for grinding inorganic matter.

DETAILED DESCRIPTION

Figure 1:
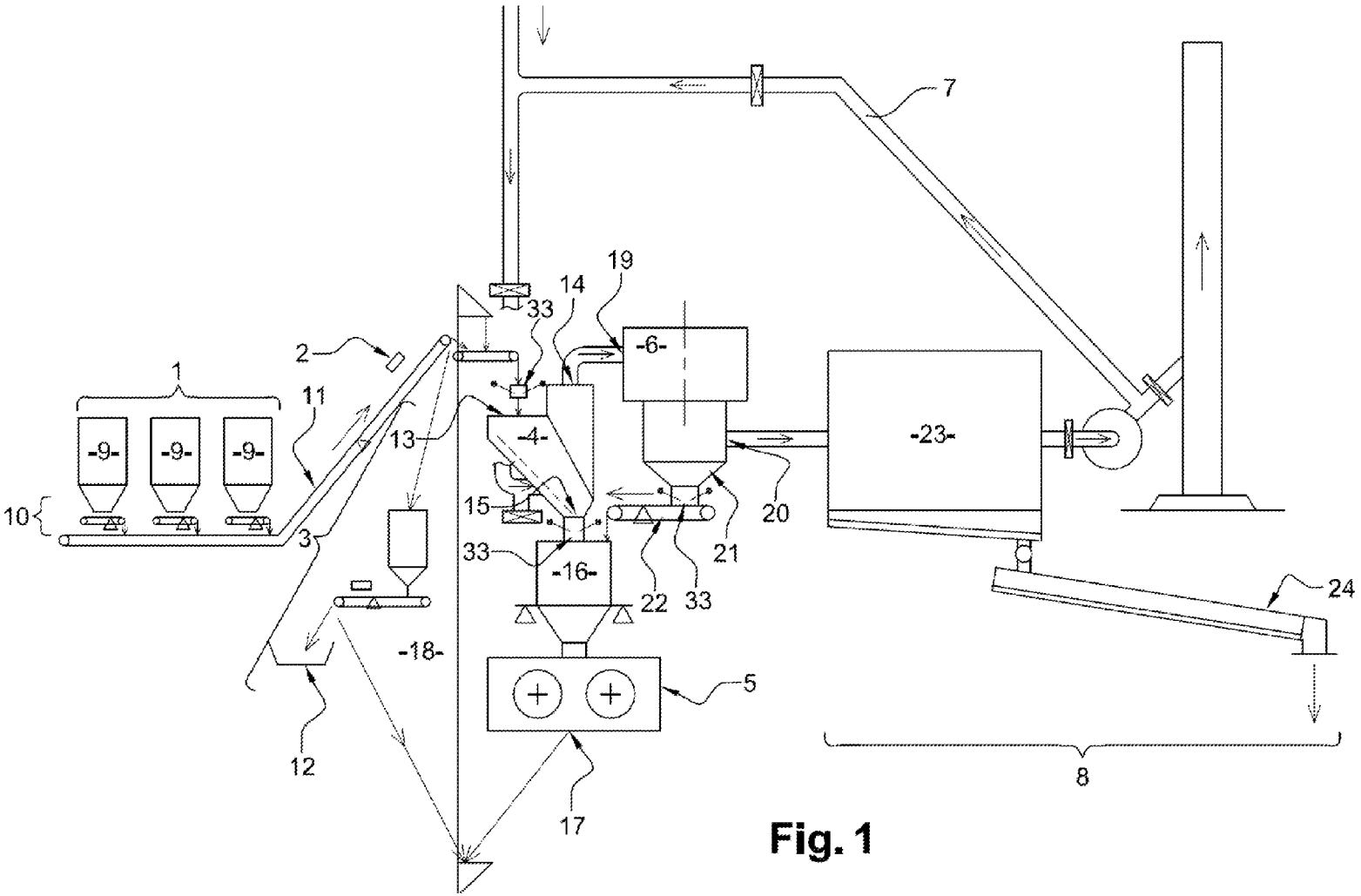
FIG. 1 is a schematic representation of a known-art grinding facility.

FIG. 1 shows a facility for grinding inorganic raw material having a roller press according to the state of the art.

Such a facility comprises a means of supplying raw material 1, means of detecting metallic matter 2, coupled with a reject circuit 3, a static separator 4, a roller press 5, a dynamic separator 6, a ventilation circuit 7, and a circulation circuit 8 for the finished product.

During operation, the inorganic matter, e.g., clinker, gypsum, and additives such as blast furnace slag or ash, is injected into the circuit of the facility. This is carried out by means of several hoppers 9, each containing one of the components necessary for the manufacture of the concrete. Each hopper is associated with a weighted dosing means 10 so as to obtain a mixture having the given composition, e.g., for CEMI concrete, 95% clinker and 5% gypsum, when the various components are introduced into the circuit of the facility.

This raw material is then transported by a conveyor 11 such as a conveyor belt, a bucket elevator, or a chain conveyor. This conveyor, in the schematic representation of FIG. 1, is a conveyor belt 11. During this transport, the raw material passes through a metallic particle detection system 2, which redirects the matter to a reject circuit 3 if the raw material contains such particles. The reject circuit 3, following a filtration procedure to selectively recover the metallic particles in a reject hopper 12, allows the sorted raw material to be redirected to the conveyor 11, which transports it, with the rest of the raw material, to the intake 13 of a static separator 4.

This static separator 4, usually of cascade type, is connected to the ventilation circuit 7. This circuit 7, either open or recirculating, allows for adjustment of the temperature of the air passing through this circuit. This adjustment is made by combining an air heater such as a hot gas generator or the heat connected to the equipment of the concrete factory such as the exhaust gases of a kiln or a cooler, and means of cooling such as the injection of outside air. Thus, according to the mode of operation of the cascade separator, i.e., the matter falling, cascade-fashion, onto several inclined walls around which the air flow of the ventilation circuit 7 circulates, the material is disintegrated by means of the collision with the inclined walls, and the low-granulometry particles that detach themselves are carried off by the air flow. The low-granulometry particles are directed by the air flow to a first output 14 of the cascade separator 4, whilst the rest of the matter is directed to the second output 15, connected to a feed hopper 16 for the roller press 5. The passage of the high-granulometry matter through this hopper 16 allows for the supply to the roller press 5 to be regulated. The high-granulometry matter is then ground by the roller press 5, and exits in a mixture of fine particles and discs of agglomerated matter. The matter thus ground is then reintroduced by means of the conveyor 18, generally a bucket elevator, into the static separator 4 at the output 17 of the press 5.

During this second passage, the discs, mixed with the raw material, are disintegrated, allowing for partial release of the low-granulometry particles, which are transported by the air flow to the first output 14 of the static separator 4. This first output 14 is connected to the intake 19 of a second, dynamic, separator 6. This separator 6, which is preferably a third-generation vertical-axle squirrel cage, allows for the selection of the particles having the required size, which are carried by the air flow to a first output 20. The rest of the matter is sent through a second output 21 and a conveyor 22, generally a conveyor belt, to the feed hopper 16 of the press 5 reduce its granulometry. The particles selected, which thus pass through the first output of the dynamic separator, are transported by the ventilation circuit 7 to a filtration device 23, which allows for collection of the finished product having the required composition and granulometry. This product is then transported by a transportation system 24 for granular products, such as an air chute 24, to be stored in storage silos before being packaged for sale or sent to the kiln following homogenization (for a facility adapted to obtain raw meal).

Figure 2:
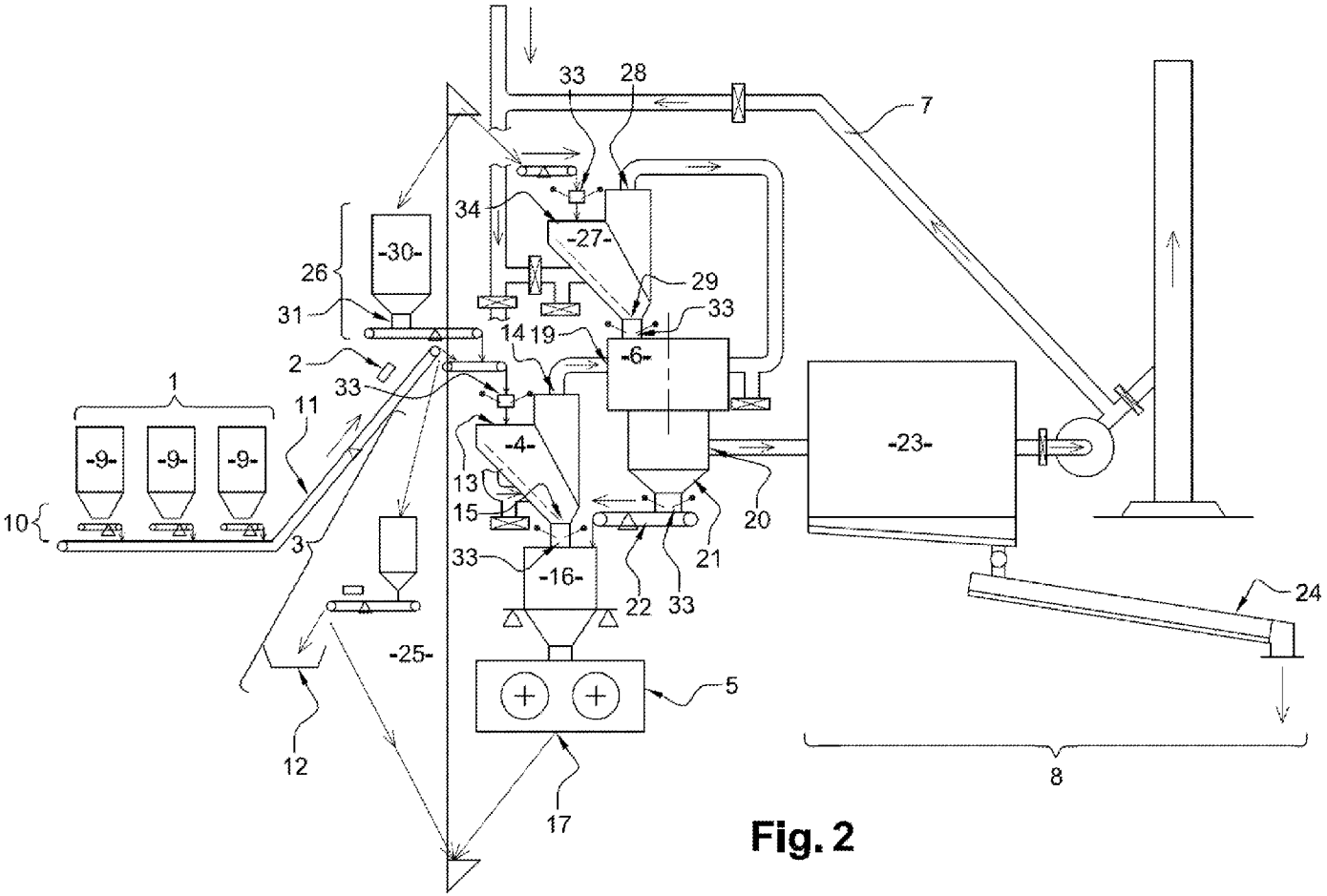
FIG. 2 is a schematic representation of a first embodiment of a grinding facility according to the invention.

FIG. 2 shows a first embodiment of a grinding facility according to the invention. Such a grinding facility differs from a prior-art facility in that the output of the press can be connected by a conveyor system 25 either to a deballasting circuit 26, or to a second static separator 27, also of cascade type, having two outputs 28,29 connected to the dynamic separator 6.

Thus, when the facility is started up, the feed hoppers 9 supply the facility with inorganic matter. As with the facility shown in FIG. 1, this raw material is sent by a conveyor system 11 to the first cascade separator 4, which carries out a first sorting of the raw material; the high-granulometry matter is sent to the press 5 through the intake hopper 16 of the press 5. When the press 5 is started up or being adjusted, the raw material, upon passing through the roller press 5, is only slightly ground. Thus, in order not to overload the press 5, the raw material, with this very slightly ground matter, is transported by the conveyor 25 to a deballasting circuit 26 comprising a deballasting hopper 30 and a means of weighted dosing 31 connected to the first cascade separator 4. The matter is then stored in the deballasting hopper 30 whilst the roller press 5 is reaching its specific rated grinding power value, e.g., a value on the order of 2 kWh/t. Once this level has been attained, the slightly ground matter stored in the deballasting hopper 30 is gradually mixed with the raw material via the first static separator 4. It thus passes again through the roller press 5 to be properly ground.

The mixture of raw material and partially ground matter, after passing through the roller press 5, is then sent in a steady state of operation to the second static separator 27. This second separator 27, in the case of this properly ground matter, allows both for disintegration and drying of the discs formed during the grinding by the roller press 5. The matter thus obtained, a mixture of coarse matter and fine particles, is sent through the two outputs 28, 29 of the second separator to the dynamic separator 6. The low-granulometry particles having been separate from the rest of the matter, the separator 6, due to its high selectivity, carries out a selective sorting, as a result of which the fine particles having the desired granulometry exit through a first output 20, and the higher-granulometry matter exists through a second output 21. The latter matter is sent back to the press 5 for another grinding, disintegration, and sorting cycle, until the desired granulometry is achieved. Particles having the desired granulometry, i.e., of a size lower than a few microns, are transported by the ventilation circuit 7 from the first output 20 of the dynamic separator 6 to a filtration device 23. This filtration device allows for the finished product with the required composition and granulometry to be collected. This product is then transported by a transportation system 24 for granular products, such as an air chute 24, to be stored in storage silos before being packaged for sale or sent to the kiln following homogenization (for a facility adapted to obtain raw meal).

A facility for grinding inorganic matter according to this embodiment, by increasing the amount of low-granulometry matter recovered after each grinding and thus increasing the performance of the entire facility, allows for a reduction in consumption per ton of ground matter of more than 16%, and a reduction by half of the capacity of the feed hopper 16, as well as the transport system 25.

Figure 3:
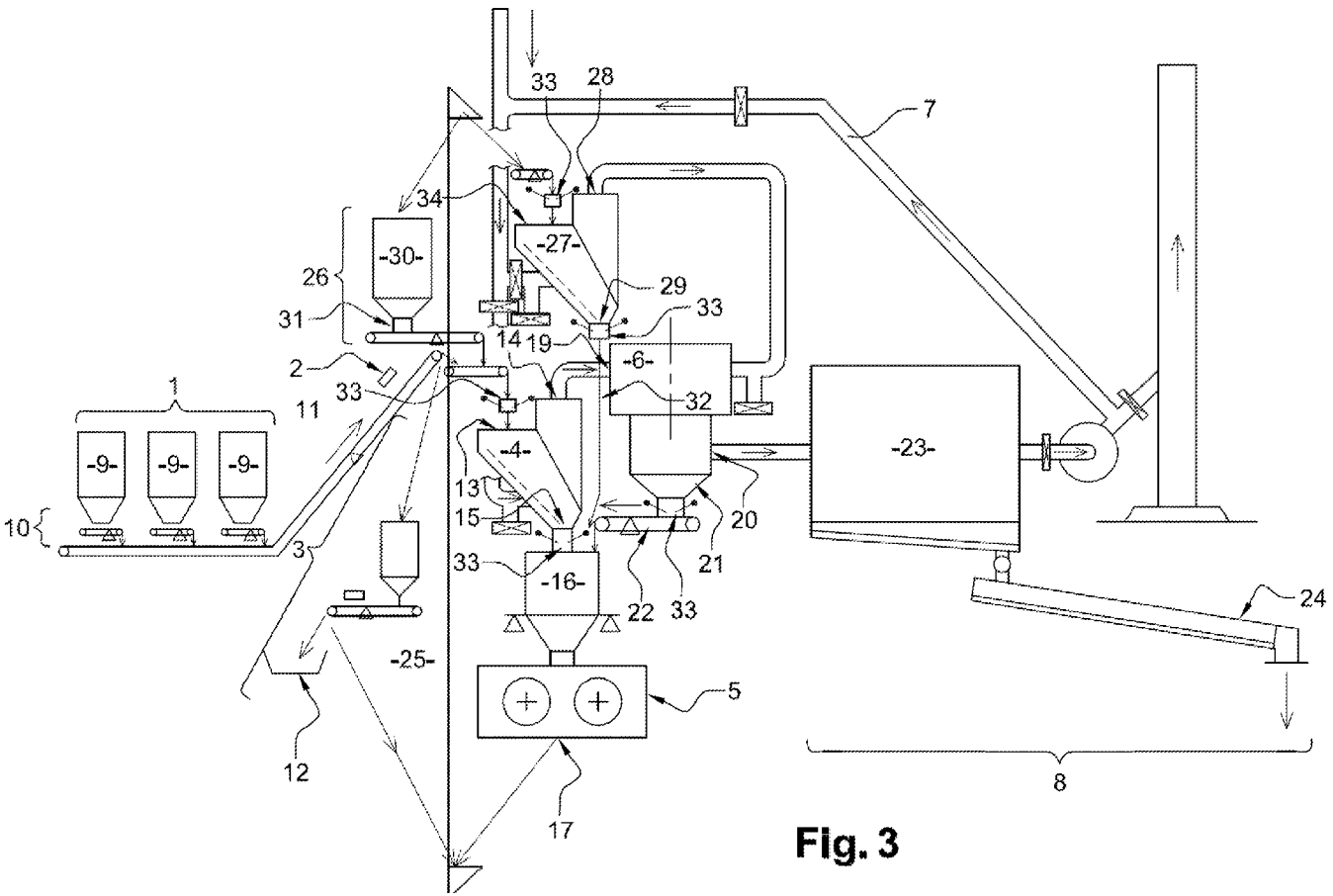
FIG. 3 is a schematic representation of a second embodiment of a grinding facility according to the invention.

FIG. 3 shows a second embodiment of a grinding facility according to the invention. Such a grinding facility differs from the first embodiment in that an output 29 of the second static separator 27, the high-granulometry matter output, is connected to a conveyor 32 to the feed hopper 16 of the roller press 5.

During operation, the feed circuit 9, 10, 11, 13 of the press and the deballasting circuit 25, 26 operate identically to the first embodiment. The change related to this second embodiment only occurs after the material has passed through the second, static, separator 27. When it does so, the high-granulometry matter, which passes through the second output 29 of the second static separator 27, is not sent to the dynamic separator 6, but directly to the feed hopper 16 of the press 5, by means of a conveyor 32. Thus, the matter rich in course materials is ground again in order to reduce its granulometry, whilst only the low-granulometry particles originating from the first outputs 24, 28 of the two static separators 4, 27 pass through the dynamic separator 6. The particles selected, as in the first embodiment, are transported by the ventilation circuit 7 to a filtration device 23, which allows for collection of the finished product having the required composition and granulometry. This product is then transported by a transportation system 24 for granular products, such as an air chute 24, to be stored in storage silos before being packaged for sale or sent to the kiln following homogenization (for a facility adapted to obtain raw meal).

A third embodiment, not shown here, comprises, for a facility similar to the first embodiment, of connecting the second output 29 of the second cascade separator 27, corresponding to the high-granulometry matter, to the conveyor 11 supplying the facility. This allows the ground matter to pass through two static separators 2, 27, thus, allowing for optimal recovery of the low-granulometry particles at each grinding by means of optimizing the disintegration of the discs arising from the grinding.

In the three embodiments shown, the deballasting circuit 26 is connected to the output of the press 17 during the deballasting phase. A possible alternative is to supply the deballasting circuit 26 during this deballasting phase from the second output 29 of the second static separator 27, which output 29 corresponds to the high-granulometry matter. In this configuration, the output 17 of the roller press 5 is directly connected, as during steady-state operation, to the intake of the second static separator 27. During this deballasting phase, this alternative allows for recovery of the low-granulometry particles arising from the partial grinding despite the low performance of the press 5.

In any embodiment of the invention, as shown by FIGS. 2 and 3, sealings 33 can be placed on the intakes 13, 34, 29 for matter and the outputs 15, 29, 21 for high-granulometry particles of the various separators 4, 27, 6. For example, the second separator has a sealing 33 on its intake 34. These sealings 33 are installed in order to limit the "false air" that may enter at the level of these separators (4, 27, 6).

Obviously, the invention is not limited to these embodiments of the grinding facility for inorganic matter described above by way of example; rather, it encompasses all possible embodiments. In particular, it can be adapted to be used to grind the raw material before cooking.

The invention claimed is:

1. Facility for grinding inorganic matter, comprising:

a roller press, a first static separator having an intake supplied with raw material, and comprising a first static output for low-granulometry matter and a second static output for matter with larger granulometry, whereby the second output is connected to roller press, a dynamic separator includes an intake connected to the first output, and further includes a first dynamic output for particles having the desired granulometry, and a second dynamic output for matter with larger granulometry connected to an intake of the roller press, a ventilation circuit provided through the first static separator and the dynamic separator in order to participate in the separation, drying, and transport of the low-granulometry particles, wherein the facility further comprises a second static separator having an intake that is solely connected to a roller output of the roller press, and at least a first separator output, for low-granulometry particles, connected to the dynamic separator, whereby the first static separator is fed only with raw material, and wherein the ventilation circuit passes through the second static separator.

2. Facility according to claim 1, the facility further comprising a deballasting circuit.

3. Facility according to claim 2, wherein the deballasting circuit comprises a hopper, an intake of which can be temporarily connected to the roller output, and an output of which is connected to the first static separator.

4. Facility according to claim 2, wherein the deballasting circuit comprises a hopper, an intake of which can be temporarily connected to the second output of the second static separator, that of the high-granulometry matter.

5. Facility according to claim 1, wherein at least one of the static separators is a static cascade separator.

6. Facility according to claim 1, wherein the raw material supply of the first static separator comprises several hoppers, a means of weighted dosing associated with each hopper, and a conveyor for conveying the material to the first static separator.

7. Facility according to claim 1, wherein the facility comprises means of detecting metallic matter, and wherein these means of detection cause the rejection of such matter via a reject circuit.

8. Facility according to claim 1, wherein the first dynamic output of the dynamic separator is connected to a filtration device, which allows for the separation of the low-granulometry particles from the air of the ventilation circuit, and wherein the filtration device is connected to a transportation system for the granular product.

9. Facility according to claim 1, wherein the intake of the roller press is equipped with a feed hopper.

10. Facility according to claim 1, wherein the second static separator further comprises a second separator output for high-granulometry matter, and wherein the second separator output is connected to the dynamic separator.

11. Facility according to claim 1, wherein the second static separator further comprises a second separator output for high-granulometry matter, and wherein the second separator output is connected to the intake of the first static separator.

12. Facility according to claim 1, wherein the second static separator further comprises a second separator output for high-granulometry matter, and wherein the second separator output is connected directly to the roller press or to the latter via a feed hopper.

* * * * *